US010806228B2

(12) United States Patent
Magliana

(10) Patent No.: US 10,806,228 B2
(45) Date of Patent: Oct. 20, 2020

(54) BAG ACCESSORY FOR RETAINING PERSONAL ITEMS AND RELATED SYSTEMS METHODS

(71) Applicant: Elizabeth Magliana, Woodland Hills, CA (US)

(72) Inventor: Elizabeth Magliana, Woodland Hills, CA (US)

( * ) Notice: Subject to any disclaimer, the term of this patent is extended or adjusted under 35 U.S.C. 154(b) by 82 days.

(21) Appl. No.: 15/908,749

(22) Filed: Feb. 28, 2018

(65) Prior Publication Data

US 2018/0242705 A1 Aug. 30, 2018

Related U.S. Application Data

(60) Provisional application No. 62/465,098, filed on Feb. 28, 2017.

(51) Int. Cl.

| | |
|---|---|
| ***A45C 13/02*** | (2006.01) |
| ***A45C 3/06*** | (2006.01) |
| ***A45C 13/08*** | (2006.01) |
| ***A45C 13/00*** | (2006.01) |
| ***A45C 11/32*** | (2006.01) |

(52) U.S. Cl.

CPC ..... *A45C 13/02* (2013.01); *A45C 3/06* (2013.01); *A45C 11/32* (2013.01); *A45C 13/001* (2013.01); *A45C 13/023* (2013.01); *A45C 13/08* (2013.01); *A45C 2013/025* (2013.01); *A45C 2013/026* (2013.01)

(58) Field of Classification Search

CPC ..... A45C 13/02; A45C 3/06; A45C 11/32; A45C 13/001; A45C 13/023; A45C 13/08; A45C 2013/025; A45C 2013/026

See application file for complete search history.

(56) References Cited

U.S. PATENT DOCUMENTS

| | | | | |
|---|---|---|---|---|
| 1,206,074 | A | 11/1916 | Zweiner et al. | |
| 1,412,011 | A * | 4/1922 | Bohm | A44B 15/00 70/456 R |
| 2,224,972 | A * | 12/1940 | Long, Jr. | A45F 5/02 24/3.6 |
| 2,455,968 | A | 12/1948 | Baker | |
| 3,007,568 | A | 11/1961 | Kurland | |
| 3,294,136 | A | 12/1966 | Cain et al. | |
| 3,326,258 | A | 6/1967 | Stucker | |
| 3,563,293 | A | 2/1971 | Fisher | |
| 3,682,216 | A | 8/1972 | Nelson | |
| 3,707,742 | A | 1/1973 | Justice et al. | |
| 4,226,105 | A * | 10/1980 | Wehrman | A45F 5/02 224/269 |

(Continued)

*Primary Examiner* — Tri M Mai

(74) *Attorney, Agent, or Firm* — Buche & Associates, P.C.; John K. Buche; Bryce A. Johnson

(57) ABSTRACT

Disclosed is a bag accessory that allows a user to easily and conveniently retain keys, cell phones, and other personal items so that the items do not shuffle around in a handbag and force a user to try and find them, which can be frustrating, time consuming, and even dangerous. The bag accessory is a hanger or clip with a magnet on one side and an embellishment on the other, wherein the magnet is used to retain keys, a cell phone, and other personal items. The invention also discloses a method of adhering a metal accessory to a cell phone case or other personal item so that items will adhere to the magnet.

3 Claims, 4 Drawing Sheets

(56) References Cited

U.S. PATENT DOCUMENTS

| | | | | |
|---|---|---|---|---|
| 4,940,250 | A | 7/1990 | Corrado | |
| 5,305,999 | A * | 4/1994 | Tate | A63B 57/207 473/406 |
| 5,388,439 | A | 2/1995 | Miller | |
| 5,620,089 | A | 4/1997 | Mills | |
| 6,796,344 | B2 | 9/2004 | Chen et al. | |
| 6,888,940 | B1 | 5/2005 | Deppen | |
| 9,392,848 | B2 * | 7/2016 | LeBlanc | A44C 1/00 |
| D773,801 | S | 12/2016 | Baldwin | |
| 9,605,696 | B1 * | 3/2017 | May | H04M 1/04 |
| 9,746,299 | B1 * | 8/2017 | Davis | F42B 39/02 |
| 2002/0034992 | A1 * | 3/2002 | Tate | A63B 57/353 473/406 |
| 2007/0012077 | A1 | 1/2007 | Remell et al. | |
| 2007/0199356 | A1 | 8/2007 | Ownes et al. | |
| 2008/0134474 | A1 * | 6/2008 | Uryasov | A45F 5/02 24/303 |
| 2015/0235120 | A1 * | 8/2015 | Warren | A44C 17/0233 235/439 |

* cited by examiner

BAG ACCESSORY FOR RETAINING PERSONAL ITEMS AND RELATED SYSTEMS METHODS

CROSS-REFERENCE TO RELATED APPLICATIONS

This application claims the benefit and priority of U.S. Provisional Pat. App. No. 62/465,098 (filed Feb. 28, 2017), entitled "Bag Accessory for Retaining Personal Items and Related Systems and Methods." That application is incorporated herein by reference as if it was fully set forth herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of accessories for bags.

Background of the Invention

For individuals who carry a purse, handbag, satchel, briefcase, or other type of bag, a constant issue that arises is trying to find keys or phones without having to dig through a purse or handbag. A lot of times individuals have their hands full with groceries, children, or other items and they need to quickly access their keys to open a door or their phone to answer a call. In this situation, individuals have to put an item down to dig through their handbag to find the keys or phone they are looking for. Looking for keys or other personal items in a handbag is not only frustrating and time consuming, but it can also be dangerous.

The bag accessory is also convenient because it allows a user to remove and attach the accessory to a multitude of handbags quickly and with ease.

Certain accessories exist that allow a user to place a key to a magnet. For example, U.S. Pat. No. 4,940,250 to Corrado discloses a magnetic key holder that is attached to the interior of a handbag, but it requires attaching the magnet to the handbag via adhered Velcro, a pin assembly, or other attachment means, which may ruin or damage the inside of a handbag and not easily moved from handbag to handbag. U.S. Pat. No. 1,206,074 to Zeiener et al discloses a clip or hanger like device with a hook placed on the interior of the handbag that is suitable to store a key ring; however, it does not provide benefit of using a magnet. There are many benefits of using a magnet: a magnet allows for metals with or without a ring to be retained; a magnet's flat surface will not get snagged on other items or on clothing; a magnet will not scratch the user as they put their hand into their purse, handbag or briefcase to retrieve other items or while digging to locate an item. The magnet holds metal objects like keys or cell phones firmly in place and readily accessible. The magnet does not allow these items to become detached or dislodged in the event that the purse, handbag, or briefcase is tipped over or the contents fall or spill to the floor, as is common while riding in a vehicle or placing an item on a desk or counter-top. The prior disclosed apparatuses do not provide the combination of using a hanger with a magnet, which provides certain benefits over using just a hanger with a hook or a magnet that needs to be attached to the inside of a handbag or two magnets placed stacked with one on the interior of a purse, handbag, or briefcase and one on the exterior.

Therefore, a need exists to create an apparatus that will retain keys, a phone, or other personal items securely in a defined location within a purse, handbag, or briefcase, or satchel, so that a user can find what he or she is looking for immediately without wasting time.

Accordingly, the present invention solves all of this need with a hanger or hinged clip apparatus that features a magnet on one end and an aesthetically pleasing embellishment on the other.

SUMMARY OF THE INVENTION

In view of the foregoing, an object of this invention is to provide a removable, replaceable, and convenient apparatus for retaining keys, phones, and other personal items in a handbag.

Another objective of the invention is to hold keys, a phone, or other personal items in place for quick and easy retrieval.

Another object of this invention is to provide an apparatus that can be switched from one handbag to another in a quick and easy manner.

Another object of this invention is to provide an apparatus that is aesthetically pleasing.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally disclosed is bag accessory for retaining keys, phones, and other personal items and is intended to be used with handbags and other carrying assemblies. The terms purse, handbag, satchel, briefcase, bag, etc. are collectively referred to herein as a "handbag" or "bag." The term "bag accessory" may also be referred to herein as "hanger" or "clip."

Figure 1:
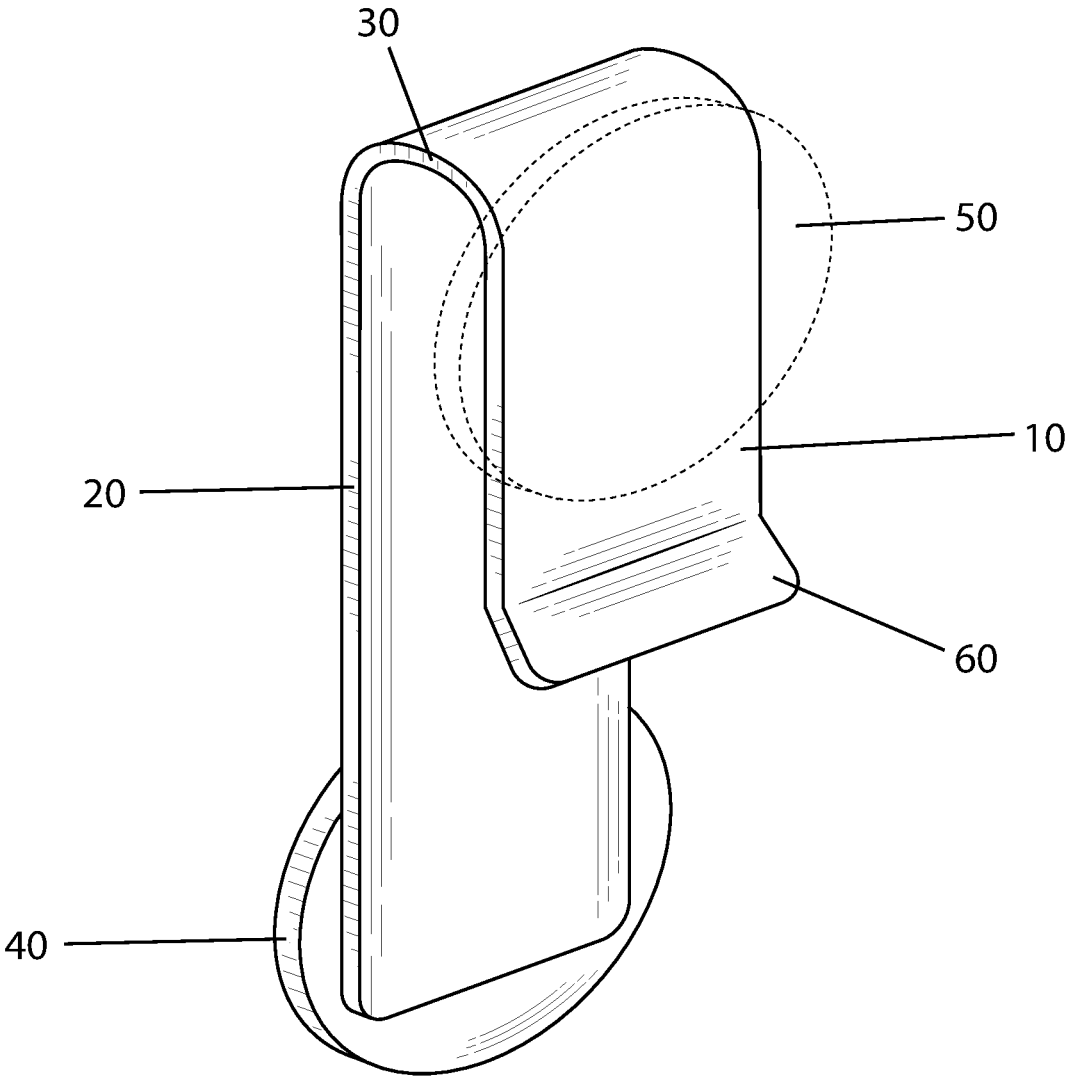
FIG. 1 is a perspective view of the bag accessory.

FIG. 1 is a perspective view of the bag accessory. Referring to FIG. 1, the bag accessory may be a hanger or a hinged clip with a front 10, a back 20, a fold 30, a magnet 40, an embellishment 50 and a flange 60. In one embodiment, a magnet 40 is fixed to the bottom portion of the back 20 of the bag accessory. In a preferred embodiment, the magnet 40 is inserted within a cabochon tray that is affixed to the bottom of the back 20. The bag accessory has a fold 30 that connects the top portion of the front 10 with the top portion of the back 20 and the fold 30 along with the flange 60 are configured to slide atop a lip of a handbag or other carrying apparatus. This allows a user to easily move the bag accessory from the lip of one handbag to another.

In a preferred embodiment, the hinged clip is a clip that features a spring biased hinge or a pivot point between the two ends of the clip, wherein the points of one end of the clip on one side of the hinge or pivot point are touching and the points on the other end of clip on the other side of the hinge or pivot point are separated. In use, the user pinches the separated end of the clip to spread apart the ends of the clip that are touching on the other side of the hinge or pivot point. This allows a user to spread the clip wide enough to fit a variety of widths of surfaces and close it on the surface so that the surfaces is in contact with the clip, whereby the clip is held in place.

Still Referring to FIG. 1, an embellishment 50 may be used, it may be fixed or removably attached to the front 10 of the bag accessory. The embellishment 50 may be a cabochon tray, wherein an insert may be removably affixed or inserted into the cabochon tray. The insert may depict a variety of designs, logos, emblems, symbols, crystals, glass, wood, stones, shells, colors, letters, numbers, or pictures. The bottom of the front 10 of the handbag apparatus features a flange 60 that allows the bag accessory to slide easily over the wall of the handbag at installation. The flange 60 also assists the user in removing the bag accessory by providing an easy grip on the bottom of the front 10.

Figure 2:
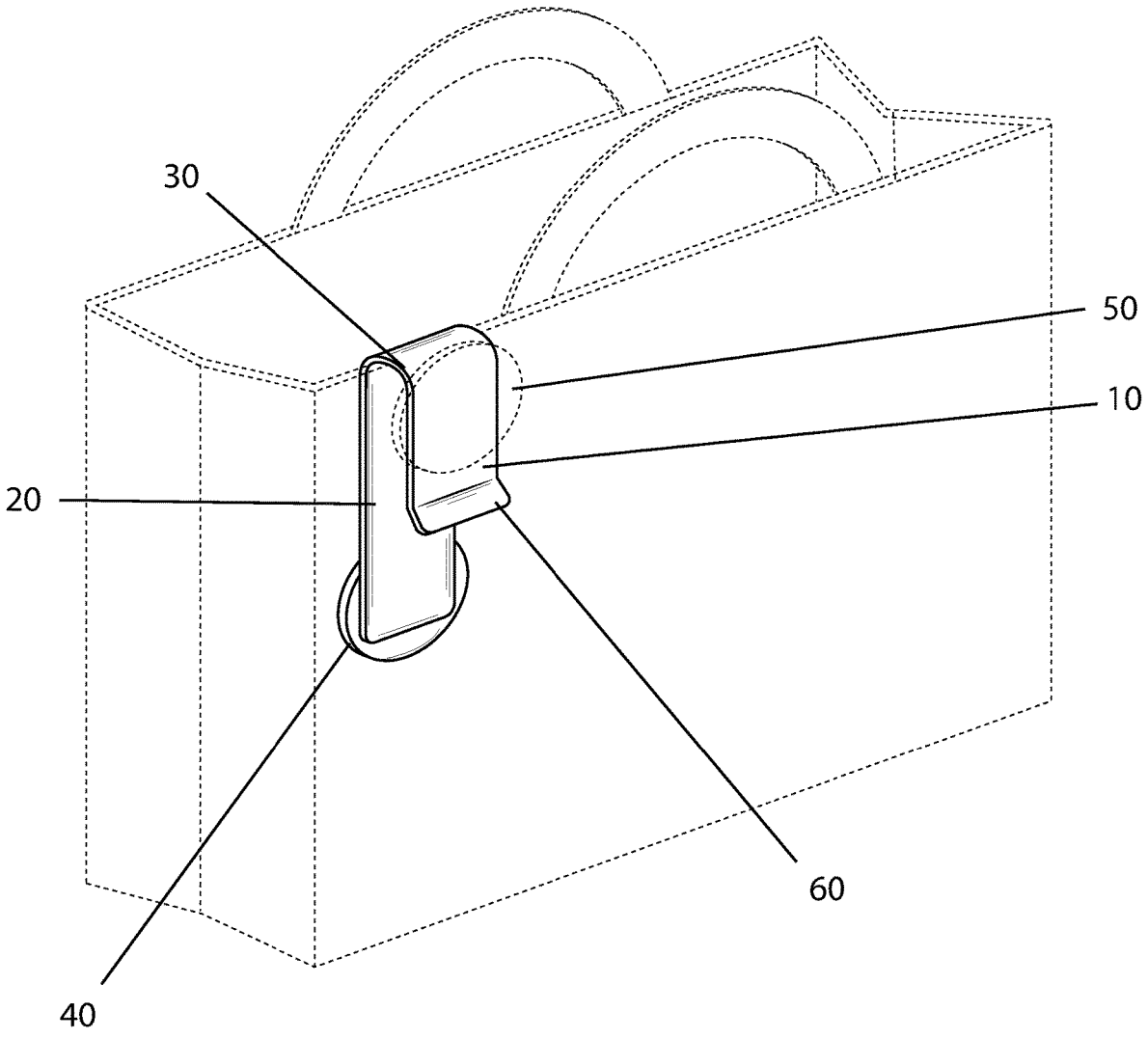
FIG. 2 is a contextual view of the bag accessory placed over the lip of a handbag.

FIG. 2 is a contextual view of the bag accessory placed over the lip of a handbag (shown in broken lines). In use, a user positions the bag accessory so that the front 10 with the embellishment 50 is facing the outside of the handbag and the back 20 with the magnet 40 is facing the inside of the handbag. Next, the user slides the bag accessory over the the lip of a handbag using the flange 60 to guide it, wherein the lip is between the front 10 and back 20, until the lip comes in contact with the fold 30. Once the bag accessory is securely in place over the lip of a handbag (shown in broken lines), the user may then add the split key ring to their own existing key ring, flashlight, or other accessory before attaching it to the magnet 40, attach keys, or attach a different metal object to the magnet 40. In one embodiment, a metal split ring may be provided to a user, so that he or she can attach keys, a key ring, or other items to the metal split ring and attach it to the magnet 40 on the bag assembly. To use the hanger (bag accessory) with a cell phone: (i) position the metal slug on the back of the cell phone case, which can be mounted either internally or externally; (ii) remove the adhesive backing; and, (iii) secure the metal slug into position prior to attaching it to the magnet 40. Because of the flexible design it should be noted that if a user desired to place the hanger (bag accessory) with the back 20 facing the exterior and the front 10 facing the interior, it would not interfere with the assembly's functionality.

Figure 3:
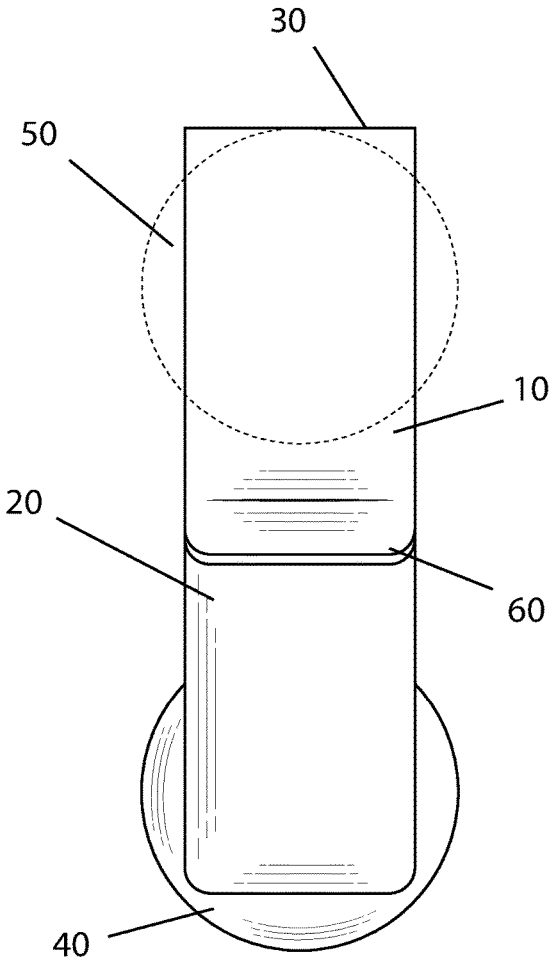
FIG. 3 is a front view of the bag accessory.
Figure 4:
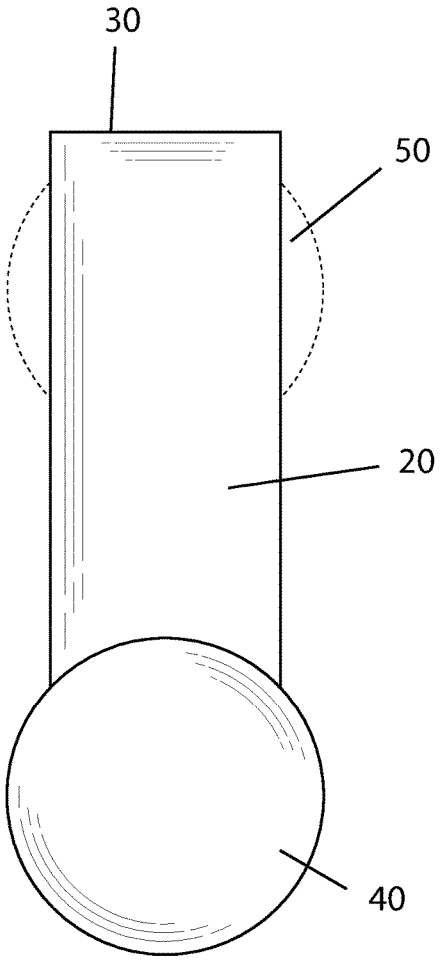
FIG. 4 is back view of the bag accessory.

FIG. 3 is a front view of the bag accessory and FIG. 4 is back view of the bag accessory. The front 10 may vary in length, but in a preferred embodiment, the front 10 is shorter in length than the back 20. In one embodiment, the length of the front is approximately 3.175 centimeters (1.25 inches) and the length of the back 20 is approximately 6.67 centimeters (2.63 inches). The length of the front 10 can be in a range from 3 to 6 centimeters and the length of the back 20 can be in a range from 6 to 7 centimeters. In one embodiment, the magnet 40 is approximately 2.54 centimeters (1 inch) in diameter and 0.32 centimeters (0.125 inches) thick, but the magnet 40 can be in a range from 2.25 cm to 2.75 cm in diameter and 0.25 to 0.75 cm thick. Referring to FIG. 3, in one embodiment the embellishment 50 is a cabochon tray, which allows for efficient installation of a desired emblem, symbol, design, logo, crystal, glass, wood, stone, shell, color, letter, numbers, or picture.

Figure 5:
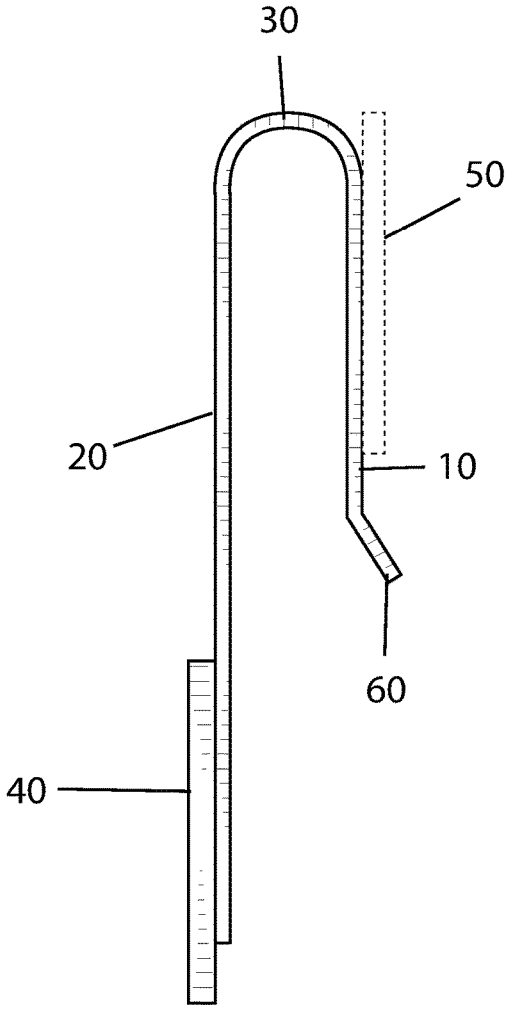
FIG. 5 is a left side view of the bag accessory.
Figure 6:
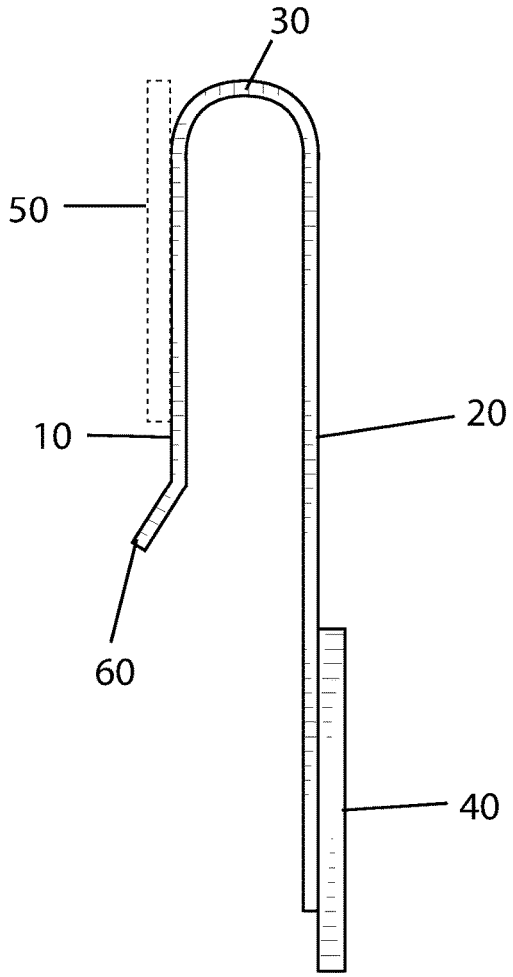
FIG. 6 is a right side view of the bag accessory.

FIG. 5 is a left side view of the bag accessory and FIG. 6 is a right side view of the bag accessory. In one embodiment, a metal accessory may be adhered or attached to the back of a cell phone or a cell phone carrying case. In a preferred embodiment, the metal accessory is a metal disk with an adhesive backing. The accessory, when attached or mounted to a cell phone, will allow the user to stick his or her cell phone to the magnet 40, and thereby retain the cell phone in a safe and consistent location so that it does not shuffle around in a handbag potentially damaging the phone or placing unwanted or unnecessary phone calls. In another embodiment, the metal accessory may be attached to any personal item that the user wants to keep in a convenient location in his or her handbag.

Figure 7:
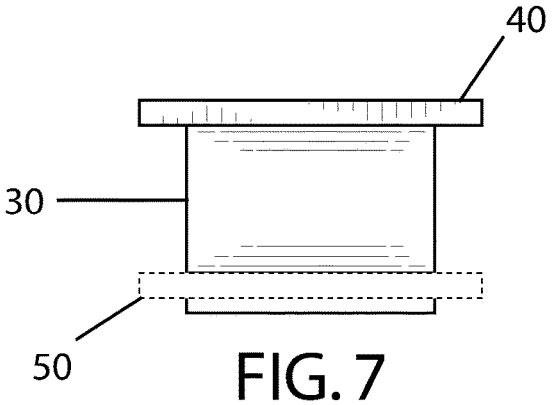
FIG. 7 is a bottom view of the bag accessory.
Figure 8:
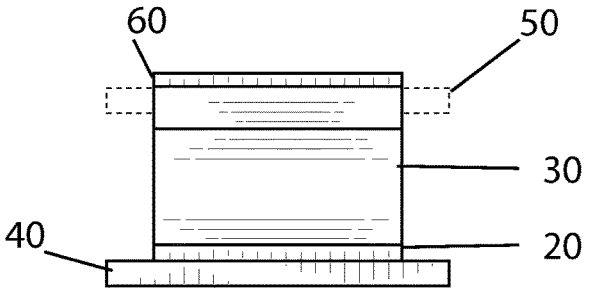
FIG. 8 is a top view of the bag accessory.

FIG. 7 is a bottom view of the bag accessory and FIG. 8 is a top view of the bag accessory. In a preferred embodiment, the bag accessory is composed of metal (i.e., aluminum, stainless steel, steel, iron, silver, titanium, gold, brass, or nickel) or a rigid plastic (i.e., polycarbonate, polyethylene, PVC, low-density polyethylene, polypropylene, or polystyrene).

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. The method of retaining a personal item on an inside of a bag while displaying an embellishment on an outside of the bag comprising:

attaching a metal object to the personal item;

ensuring that bag has an inside, an outside, and a lip;

obtaining a bag accessory defined by (a) a ribbon of metal or rigid plastic that is at least approximately 9.845 centimeters long and that has been folded to define a hinged clip with (i) a front (10) that is approximately 3.175 centimeters long, (ii) a back (20) that is approximately 6.67 centimeters long, (iii) a fold (30) that connects a top portion of the front (10) with a top portion of the back (20), and (iv) a flange (60), wherein the fold (30) along with the flange (60) are configured to slide atop the lip of the bag;

(b) an approximately 0.32 centimeter thick disk-shaped magnet (40) with an approximately 2.54 centimeter diameter that is disposed within a circular cabochon tray that has been affixed to a bottom portion of the back (20), and, (c) a disk-shaped embellishment (50) that has been inserted into a circular cabochon tray that has been affixed to a bottom portion of the front (10);

placing the clip over the lip of the bag by sliding the fold (30) along with the flange (60) atop the lip of the bag;

using the flange (60) to guide the clip over the lip until the front of the clip is facing outside of the bag so that the disk-shaped embellishment (5) is displayed on the outside of the bag, the back of the clip is facing toward the inside of the bag, and the lip of the bag is in contact with the fold at the top of the clip; and, contacting the metal object to the disk-shaped magnet (40) on the back (20) of the clip so that the personal item is magnetically attached to the bag accessory on the inside of the bag.

2. The method of claim 1, wherein the personal item is a set of keys and the metal object is a metal split ring for use with an existing key ring.

3. The method of claim 1, wherein the personal item is a cell phone and the metal object is a slug.

* * * * *